United States Patent [19]

Müeller

[11] Patent Number: 4,502,513

[45] Date of Patent: Mar. 5, 1985

[54] STRAP FABRIC AND METHOD OF AND MACHINE FOR MANUFACTURING THE STRAP FABRIC

[75] Inventor: Jakob Müeller, Stansstad, Switzerland

[73] Assignee: Textilma, AG, Hergiswil, Switzerland

[21] Appl. No.: 524,462

[22] Filed: Aug. 18, 1983

Related U.S. Application Data

[63] Continuation of Ser. No. 157,644, Jun. 6, 1980, abandoned.

[30] Foreign Application Priority Data

Jun. 19, 1979 [CH] Switzerland ..... 5716/79

[51] Int. Cl.[3] ..... D03D 5/00

[52] U.S. Cl. ..... 139/383 R; 139/430; 139/432

[58] Field of Search ..... 139/116, 431, 432, 383 R, 139/430; 66/202, 169 A; 156/148, 393; 428/192, 193, 194

[56] References Cited

U.S. PATENT DOCUMENTS

| | | | |
|---|---|---|---|
| 1,854,693 | 4/1932 | Dickie et al. | 139/116 |
| 2,584,891 | 2/1952 | Libby | 139/432 |
| 2,811,029 | 10/1957 | Conner | 66/202 |
| 2,840,117 | 6/1958 | Scruggs | 139/383 R |
| 2,922,442 | 1/1960 | Webber | 428/193 |
| 3,286,490 | 11/1966 | Martin | 66/169 A |
| 3,515,623 | 6/1970 | Bates | 428/193 |

FOREIGN PATENT DOCUMENTS

| | | | |
|---|---|---|---|
| 2356754 | 9/1960 | France | 139/432 |

*Primary Examiner*—Henry S. Jaudon
*Attorney, Agent, or Firm*—Michael J. Striker

[57] ABSTRACT

The strap-like fabric made of interwoven weft and warp yarns has a selvage in the form of knitted stitches. A binding yarn made of a thermoplastic material or covered with an adhesive layer is applied to the cross points of respective loops of the knitted stitches and is united with the cross points by a heat treatment to form firm connection points either by cementing or by welding. The connection points prevent unweaving of the fabric when the weft yarn or the binding yarn accidentally breaks.

7 Claims, 3 Drawing Figures

STRAP FABRIC AND METHOD OF AND MACHINE FOR MANUFACTURING THE STRAP FABRIC

This is a continuation of application Ser. No. 157,644, filed June 6, 1980, now abandoned.

BACKGROUND OF THE INVENTION

The invention relates generally to a strap-like fabric including a warp, a weft and a selvage formed by knitted stitches interconnecting the ends of the weft and it also relates to a method of and a device for manufacturing such a strap-like fabric.

Strap fabrics having weft yarns interconnected by knitted stitches are generally known and have the disadvantage that even upon the breakage of a single strand of yarn the whole fabric is prone to ravel. It is particularly a strap fabric made of synthetic strands of yarns where the danger of raveling is largest and consequently the applicability of such strap fabrics is frequently impaired or brings about considerable dangers. For example, if the strap-like fabrics are employed as carrying or safety belts the breakage of a single strand can have disastrous consequences.

Attempts have already been made in strap fabrics having a selvage formed by knitted stitches to avoid the aforementioned disadvantage qualities of the fabric by locking the weft yarns by means of additional locking yarns. This nonsolution however causes another disadvantage inasmuch as the knitted portion causes an increase in the thickness of the edge of the fabric which not only produces a different appearance of the edges but also to an increased vulnerability of the latter.

SUMMARY OF THE INVENTION

A general object of the present invention is therefore to overcome the aforementioned disadvantages.

More particularly, it is an object of the invention to provide an improved strap-like fabric which has an increased resistance against becoming unwoven.

Another object of the invention is to provide such an improved fabric which has knitted selvage correspondingly finished so as to prevent raveling.

Still another feature of this invention is to provide such an improved strap fabric which is easy to manufacture.

An additional object of the invention is also to provide a new method of manufacturing such an improved strap fabric.

A further object of this invention is to provide a weaving machine for carrying out this method.

In keeping with these objects and others which will become apparent hereafter, one feature of the inventon resides in the provision of a plurality of firm connection points formed in the selvage of the fabric by welding or cementing at least some cross points in the stitches. Preferably, at least one binding yarn is applied to the selvage and thereupon, according to the method of this invention, the cross points between the loops of the stitches are united by cementing or welding.

The weaving machine for producing the strap fabric includes a means for forming knitted stitches at the ends of the weft yarn, and a heating device adjoining the knitting means to weld the crossing portions of the weft loops by thermal treatment.

Preferably, the strap fabric of this invention includes a binding strand of yarn which is knitted into a chain of stitches interconnecting the looped ends of the weft yarn and the cross points of respective loops formed on this additional binding yarn united by welding or cementing into the firm connection points.

By means of the above measures a surprisingly ravel resistant strap fabric is obtained whereby any increase in thickness at the edges of the fabric is avoided and the appearance as well as the smoothness and flexibility of the fabric of this invention corresponds to a conventional one. The manufacturing method of the fabric of this invention is very simple and can be carried out on conventional weaving machines provided with correspondingly simple modifications and attachments.

According to still another modification, an additional binding yarn is interlooped with the end loops of weft yarn and the knitted stitches of this additional binding yarn are united at their cross points to form the firm connection points. In the latter case it is of advantage when the additional binding yarn apart from the cross points remains undisturbed by the application of heat. This condition can be fulfilled for example by applying a cement or adhesion agent on sections of the binding yarn whereby the cement is responsive to a heat treatment whereas the remaining sections of the additional binding yarn are heat resistant. If the cross points of the loop binding yarn are to be united by welding, so it is advantageous when the binding yarn includes threads of a thermoplastic material the melting point of which is lower than that of the remaining component threads so that at least a portion of the binding yarn remains undisturbed by the heat treatment.

In many cases it is preferred when the additional binding yarn is knitted together with the end loops of the weft yarn into the chain of selvage stitches. This auxiliary binding yarn for reinforcing the end loops of the weft yarn includes threads of thermoplastic material the melting point of which is lower than that of the remaining component threads and only the thermoplastic components are welded or fused into the firm connection points. Since in this case the binding additional yarn is not interwoven into the texture of the fabric, it can be interrupted during the formation of the firm connection points without any disadvantageous effects. Nonetheless, even in this case it is preferred when the additional binding yarn is composed of a core surrounded by a jacket layer which melts faster or at a lower temperature than the core. In a variation, the auxiliary binding yarn is covered at least at regular intervals with an adhesive layer which is susceptible to a heat treatment. In the former case, the core of the binding yarn can be made of an unfusable material such as glass fibers or a metal wire and the jacket is made of an easily fusable material. The core and jacket layer of the yarn may be made also of the same material whereby the core is thicker than the fibers or threads which are wound around the core to form the jacket layer. The outer threads will melt faster than the inner core in spite of the same material.

In manufacturing the strap-like fabric of this invention the binding yarn immediately before its interlooping in the selvage is provided with the layer of an adhesive agent which upon interlooping of the binding yarn hardens and thus forms the firm connection points at the cross sections between individual loops. It is also possible to employ a binding yarn which is soluble in a solvent so that upon knitting the binding thread in the selevage the solvent is applied on the cross points of the loops and the dissolved yarn material is allowed to set.

The preferred manufacturing method of this invention is, however, the thermal treatment of the binding yarn so that the formation of firm connection points is accelerated and at the same time the cross points to be united can be accurately defined. If the binding yarn is formed by a warp strand extending in the longitudinal direction of the fabric strand the heat treatment can take place over the entire width of the binding strand. The heat treatment of the strap fabric of this invention can follow at any instant after the interlooping of the weft yarn; nonetheless, it is of advantage when the binding yarn is heated immediately after beating up of the weft. In order to prevent the shrinkage or deformation of the heat treated fabric, the heat is applied preferably over the entire width of the fabric.

In the embodiment where the binding yarn is used exclusively for the formation of the firm connection points but is not part of the woven texture of the fabric, so it is advantageous when this binding yarn is made of a thermoplastic material the melting point of which is lower than that of the remaining yarns or strands of the fabric. If, however, the additional binding yarn is intended to participate in the loading function of the fabric, it is preferably made of a central core surrounded by a jacket layer which melts faster or at a lower temperature than the core.

The machine for the production of the strap fabric of this invention, as mentioned before, includes a heating device arranged in the selvage range of the woven fabric. In a modification, the heating device can extend over the entire width of the fabric or it can be arranged to act only upon the edges of the fabric in the range of the selvage. The heating device may include any conventional source of heat such as heated wire, a nozzle for hot air and the like.

The novel features which are considered as characteristic for the invention are set forth in particular in the appended claims. The invention itself, however, both as to its construction and its method of operation, together with the original objects and advantages thereof, will be best understood from the following description of specific embodiments when read in connection with the accompanying drawing.

DESCRIPTION OF THE PREFERRED EMBODIMENTS

Figure 1:
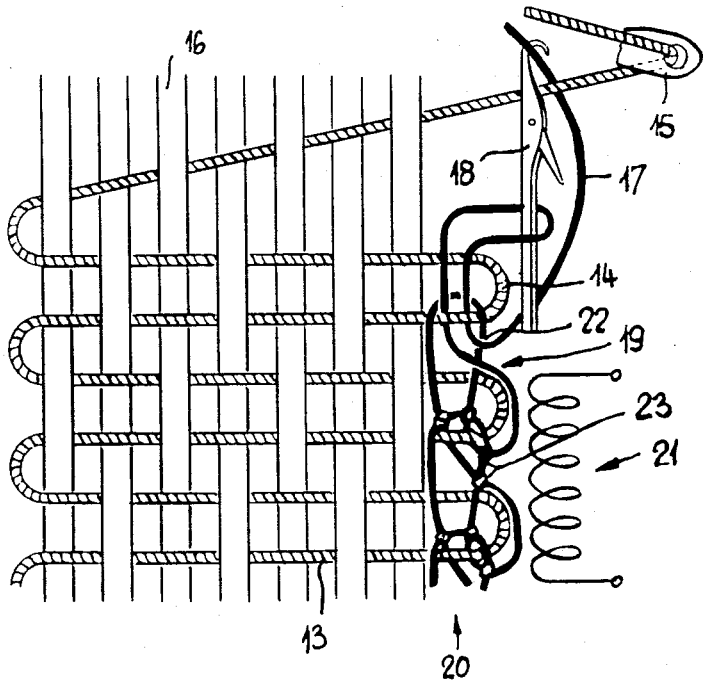
FIG. 1 is a second embodiment of the strap fabric of this invention including an additional binding yarn interlooped with the end loops of the weft yarn.
Figure 3:
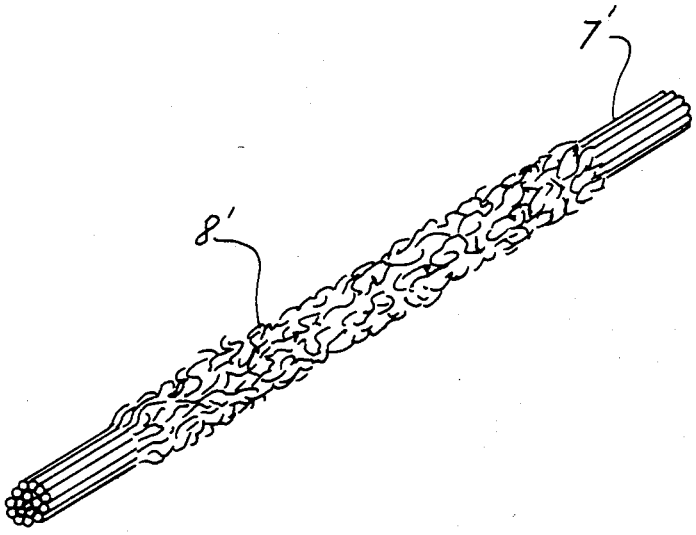
FIG. 3 is a perspective view of a modified binding yarn of FIG. 2.

FIG. 1 illustrates an embodiment of the fabric of this invention wherein weft yarn 13 is interwoven with warp yarn 16 by means of a picking member 15 and formed with end loops 14. In this embodiment, the end loops 14 are interconnected by an additional binding yarn 17 which is knitted by means of a knitting needle 18 into warp-like loops 19 to form selvage 20. Preferably, the additional binding yarn 17 has a core 7' of a non-melting material which is coated by a layer 8' of thermoplastic material FIG. 3. A heating device 21 arranged in close proximity to the selvage 20 heats the thermoplastic coating of the binding yarn 17 to such a degree that the cross points 22 of respective loops of the stitches are welded together to form firm connection points 23. The welded connection points 23 ensure that the loops 14 of the weft yarn are reliably tied one to the other so that even after an accidental breakage of a filling 13 or of the binding yarn 17, no raveling of the fabric will occur.

Figure 2:
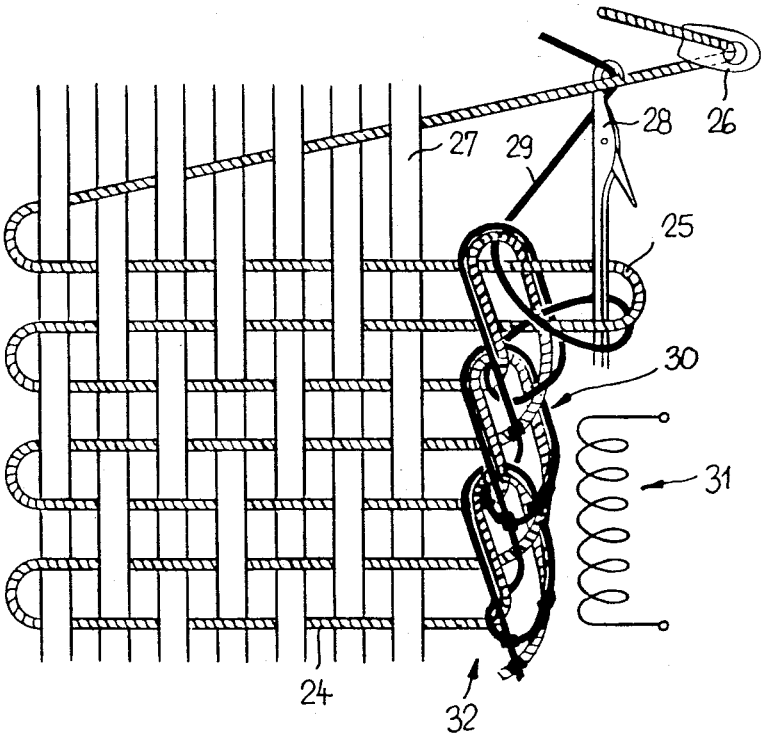
FIG. 2 is a third embodiment of the fabric of this invention having a knitted selvage formed by interlooping ends of the weft yarn reinforced on both sides by an additional binding thread.

FIG. 2 shows a second embodiment of the strap fabric of this invention which is produced by means of a picking member 15 which intermeshes weft yarn 24 with warp yarn 27 and forms weft loops 25 at lateral edges of the fabric. The weft loops 25 at one edge of the fabric are interlooped by means of a knitting needle 28 but in this case an additional reinforcing binding yarn 29 is knitted together with the loops 25 into warp-like stitches 30 forming the selvage 32. Inasmuch as the auxiliary binding yarn 29 does not participate in the woven texture of the fabric but serves merely for reinforcing the selvage forming stitches 30, it can be made completely of a thermoplastic material. A heating device 31 arranged at the selvage 32 heats the binding yarn 30 until the latter melts and fuses together its own cross points as well as the cross points with the loops 35 of the weft yarn. The warp-like knitted selvage 32 is therefore held together by the firm connection points and cannot be unwound in the case of the breakage of a yarn.

Numerous modifications and variations in design are possible in the strap fabric of this invention. For example, in one variation the weft yarn itself is employed for the formation of the firm connection points in the knitted stitches whereby as it has been described before, the weft yarn is composed of a non-meltable core made for example of glass fibers or of metal and coated with a layer of a thermoplastic material. In another variation both the core and the coating are made of the same material whereby the core consists of thick fibers and surrounded by thin thermoplastic fibers. The thin fibers or threads on the coating melt faster than the thick core so that the binding portion of the weft yarn is not destroyed by heating. For this purpose, the heating treatment is made in doses. By heating an arbitrary range across the strap fabric, a welding of the thermoplastic weft yarn through underlying cross yarns is possible; nonetheless, it is preferred to weld the firm connection points at the selvage range of the fabric.

Also in the embodiments according to FIGS. 1 and 2, it is possible to employ instead of thermoplastic binding yarns a yarn which at least partially is covered with a binding or adhesive agent.

It will be understood that each of the elements discussed above, or two or more together, may also find a useful application in other types of constructions differing from the types discussed above.

While the invention has been illustrated and described as embodied in specific examples of a strap-like fabric, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A strap-like fabric comprising a warp, a weft, an additional binding yarn and a knitted selvage formed of end loops of the weft and of loops of the additional binding yarn knitted in said end loops of the weft, said additional binding yarn being located in said end loops of the weft outside of the woven texture of the fabric, said loops of the additional binding yarn having crossing points and being firmly connected one to another at said crossing points by welding to form a plurality of firm points in said selvage, said additional binding yarn including a plurality of components at least one of which is of a thermoplastic material the melting point of which is lower than that of the weft yarn so as to weld together the thermoplastic material at said crossing points into said firm points.

2. A strap-like fabric as defined in claim 1 wherein said binding yarn is at least partially coated with a layer of an adhesive agent.

3. A strap-like fabric as defined in claim 1, wherein said end loops of the weft are knitted along the edge of the fabric, and being located outside of the woen texture of the fabric.

4. A strap-like fabric as defined in claim 1 wherein said additional binding yarn includes a core provided with a jacket layer which melts at a lower temperature than the core.

5. A strap-like fabric comprising a warp, a weft and a knitted selvage formed of interlooped ends of the weft, and further comprising loops of an additional binding yarn knitted in the end loops of the weft along said selvage and being located in said end loops of the weft outside of the woven texture of the fabric, and further comprising crossing points of said end loops of the weft and said loops of the additional binding yarn, said binding yarn being firmly connected to said end loops of the weft at said crossing points by welding to form a plurality of firm points in said selvage, said additional binding yarn including a plurality of components at least one of which is of a thermoplastic material the melting point of which is lower than that of the weft yarn so as to weld together the thermoplastic material at said crossing points into said firm points.

6. A strap-like fabric as defined in claim 5 wherein said additional binding yarn includes a core provided with a jacket layer which melts faster than the core.

7. A strap-like fabric as defined in claim 5 wherein said additional binding yarn is at least partially coated with a layer of an adhesive agent.

* * * * *